US005711259A

United States Patent [19]

Pischinger et al.

[11] Patent Number: 5,711,259

[45] Date of Patent: Jan. 27, 1998

[54] METHOD OF MEASURING A VALVE PLAY OF AN ENGINE-CYLINDER VALVE OPERATED BY AN ELECTROMAGNETIC ACTUATOR

[75] Inventors: Franz Pischinger; Günter Schmitz; Martin Pischinger, all of Aachen, Germany

[73] Assignee: FEV Motorentechnik GmbH & Co. KG, Aachen, Germany

[21] Appl. No.: 694,273

[22] Filed: Aug. 8, 1996

[30] Foreign Application Priority Data

Aug. 8, 1995 [DE] Germany ..... 195 29 155.7

[51] Int. Cl.[6] ..... F01L 1/20; F01L 9/04

[52] U.S. Cl. ..... 123/90.11; 251/129.01

[58] Field of Search ..... 123/90.11; 251/129.01, 251/129.15, 129.16, 129.18

[56] References Cited

U.S. PATENT DOCUMENTS 4,719,882 1/1988 Kreuter ..... 123/90.11

5,080,323 1/1992 Kreuter ..... 123/90.11

5,269,269 12/1993 Kreuter ..... 123/90.11

*Primary Examiner*—Weilun Lo

*Attorney, Agent, or Firm*—Spencer & Frank

[57] ABSTRACT

A method of measuring a valve play in a reciprocating valve. The valve has open and closed positions and is operated by an electromagnetic actuator which includes an opening electromagnet, a closing electromagnet, an armature movable between pole faces by electromagnetic forces against a spring force of a return spring arrangement for moving the valve into an open position. The valve play is defined by a clearance between the armature and the valve when the armature is in contact with the pole face of the closing magnet and the valve is in the closed position. The method includes the steps of detecting a motion of the armature within the clearance as a function of the course of voltage and/or current in the closing electromagnet; and deriving the size of the valve play from an irregularity (spike) in the course of voltage and/or current. The irregularity is caused by an impacting of the armature on the valve and/or the pole face of the closing electromagnet.

10 Claims, 1 Drawing Sheet

METHOD OF MEASURING A VALVE PLAY OF AN ENGINE-CYLINDER VALVE OPERATED BY AN ELECTROMAGNETIC ACTUATOR

CROSS REFERENCE TO RELATED APPLICATION

This application claims the priority of German Application No. 195 29 155.7 filed Aug. 8, 1995, which is incorporated herein by reference.

BACKGROUND OF THE INVENTION

In internal combustion engines the individual cylinder valves are maintained in the closed position by a closing spring, and the valve may be lifted (opened) only by overcoming the force of the closing spring. To ensure that the cylinder valve is reliably closed, no positive (fixed) connection exists between the valve operating mechanism and the cylinder valve itself; rather, between the two components a clearance is provided which constitutes a valve play. Such a clearance prevents that, for example, because of thermal expansions of the components in different operational conditions, the valve either does not close properly or is not in a proper operating relationship with the actuating mechanism.

When an electromagnetic valve actuator is used which has a closing magnet, an opening magnet as well as an armature which is reciprocated against the force of a return spring between the two electromagnets and which operates the cylinder valve and in which one of the return springs constitutes the closing spring for the valve, the actuating arrangement has to be designed such that, on the one hand, the armature engages the pole face of the closing magnet in the closed state of the valve and, on the other hand, upon energization of the opening magnet, the valve reliably opens in the desired manner. If the armature is firmly connected with the valve, then, because of thermal expansions under different operational conditions, similarly to other actuators, either the valve does not close properly or the armature does not lie against the pole face of the closing magnet. Because of the closed structural design of electromagnetic actuators of this type, the clearance which is present between the armature and the terminus of the valve stem and which constitutes the valve play is practically inaccessible so that a mechanical measurement is, for all practical purposes, not feasible.

SUMMARY OF THE INVENTION

It is an object of the invention to provide an improved method of measuring the valve play of an engine-cylinder valve operated by an electromagnetic actuator.

This object and others to become apparent as the specification progresses, are accomplished by the invention, according to which, briefly stated, the method of measuring a valve play in a reciprocating valve operated by an electromagnetic actuator includes the steps of detecting a motion of the armature towards the valve dwelling in the closed position as a function of the course of voltage and/or current in the closing electromagnet; and deriving the size of the valve play from an irregularity (spike) in the course of voltage and/or current. The irregularity is caused by an impacting of the armature on the valve and/or the pole face of the closing electromagnet.

If the cylinder valve is in the closed position due to the energized state of the closing magnet, the holding current is discontinued so that under the effect of the return spring biased in the opening direction, the armature moves in the opening direction and after having travelled a distance determined by the valve play, it impacts on the stem of the cylinder valve, as a result of which the armature is abruptly braked. Dependent upon design, the deenergization of the holding magnet may be effected by immediately dropping the current to zero. Due to the decay of the magnetic field, the zero value for the current is obtained only after a certain delay. It is also possible to decrease the holding current to zero in a controlled manner to obtain a defined current and voltage course. Since the impacting of the armature on the end of the stem (or on an abutment disk mounted on the end of the stem) occurs for the given play magnitudes during a period in which the reduction of the holding current takes place, the sudden change in the inductivity causes a distinct irregularity (spike) in the voltage or current curve. From such an irregularity, in conjunction with a corresponding time measurement if needed, conclusions may be drawn concerning the magnitude of the valve play. The accuracy may be further increased by considering the sticking period of the armature at the holding magnet when the course of the voltage and/or the current is evaluated. Such sticking period may be taken into account by a corresponding predetermined time and/or by recognizing significant deviations in the voltage or current curve.

According to a preferred embodiment of the method of the invention, the armature is held in one of the two end positions of the valve play and the closing magnet is energized and further, the course of the voltage or current in the solenoid of the closing magnet is detected from the moment of energization. This method may have two variants. According to a first version, the valve is held in its closed position by applying a current to the closing magnet. The concept "energization" in the meaning of the present method includes, on the one hand, the total removal of the holding current to a zero value so that the voltage and/or current course may be determined based on the decay of the magnetic field of the closing magnet. On the other hand, the concept of "deenergization" also includes a regulated decrease of the current from the level of the holding current to zero. Further, the concept includes a mode of operation in which the current is set to zero but, in addition to the moment of deenergization, the sticking period of the armature at the magnet is also taken into consideration, whether it concerns a fixed time period or whether it is taken into account by recognizing the beginning of armature motion. Also, the concept includes a procedure according to which the holding current at the closing magnet is discontinued and then switched on for a short period so that the armature first moves in the opening direction but is immediately thereafter again captured by the closing magnet.

Instead of or in addition to the detected meaningful events in the voltage and/or current course, for which, if required, data concerning the beginning of the armature motion are also taken into consideration, according to the method of the invention it is also feasible to derive the size of the valve play by measuring the time lapse between the switching of the current and the irregularity (spike) in the course of the current and/or voltage. Such an irregularity is caused by the impacting of the armature on the valve face constituting the end of the valve play to be measured. Thereafter, the measured times may be compared with predetermined calibration curves under the assumption that during an engine inspection which includes the checking of the valve play, first the engine operation as such is tested to ensure that the individual cylinder valves are not interfered with in their free motion by an increased friction or other mechanically influenced irregularities.

The above-outlined process is advantageous in that the valve play may be verified by means of purely electrical measures within the framework of an electronic engine monitoring without the need for opening the valve cover to gain access to the actuators.

According to a variant of the process according to the invention which, however, requires an access to the actuators, the cylinder valve is mechanically arrested in its closed position. As a result, when the closing magnet is energized, the armature can move only within the available valve play. In such a method it is advantageous to first deenergize the closing magnet so that the armature lies against the abutment disk mounted on the valve stem and then to energize the closing magnet. Since the magnetic force decreases exponentially, that is, it decreases as a function of the square of the increasing distance between the armature and the pole face, the beginning of the motion of the armature in the direction of the closing magnet against the force of the return spring depends from the current intensity and the size of the valve play. Therefore, for each given armature distance there is required a determined current intensity to move the armature from the end position at the cylinder valve into its end position at the pole face of the closing magnet. Therefore, the magnitude of the valve play may be derived from the detected current intensity.

According to yet another embodiment of the process of the invention, the cylinder valve is held in the closed position by at least partially relaxing the return spring acting on the armature. The return spring is relaxed advantageously to such an extent that the position of equilibrium between the return spring effective in the closing direction and the return spring effective in the opening direction is shifted to such an extent toward the electromagnetic actuator that the cylinder valve is held in the closed position by the closing spring. This then permits to derive the magnitude of the valve play from the detected data of the motion behavior by energizing the closing magnet or by switching the energized closing magnet so that the armature moves from the pole face of the closing magnet until it contacts the abutment disk of the valve stem.

The above-described various processes as well as the evaluation may be automated such that the method for measuring the valve play is integrated in a diagnostic system which displays the measured valve play or a deviation from a desired value.

BRIEF DESCRIPTION OF THE DRAWING

The FIG. 1 is a sectional side elevational view of an electromagnetic actuator-operated engine cylinder valve with which the method according to the invention may be performed.

DESCRIPTION OF THE PREFERRED EMBODIMENTS

Figure 2A:
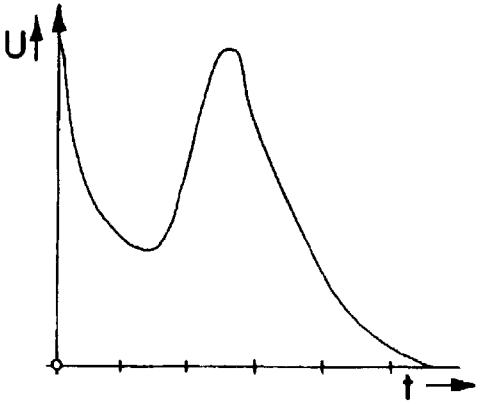
FIGS. 2*a*, 2*b*, 2*c* and 2*d* show voltage curves for four different gap widths in the electromagnetic actuator.
Figure 2B:
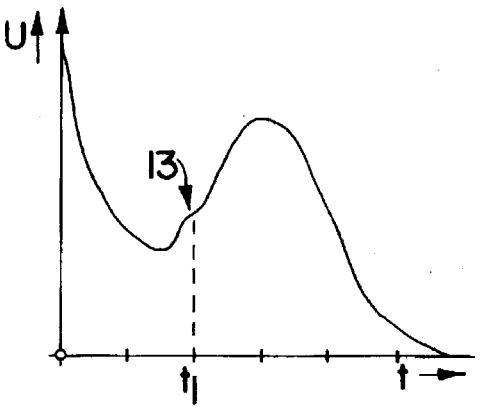
Figure 2C:
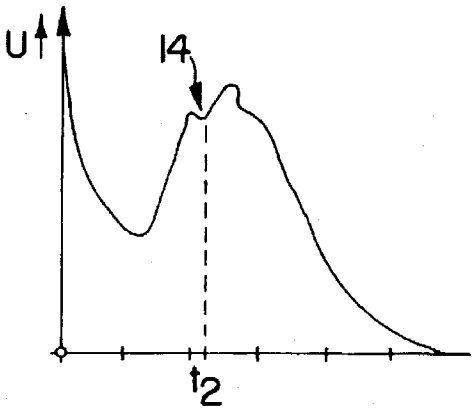
Figure 2D:
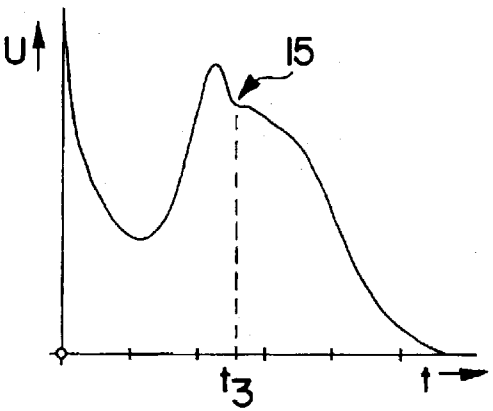
Figure 1:
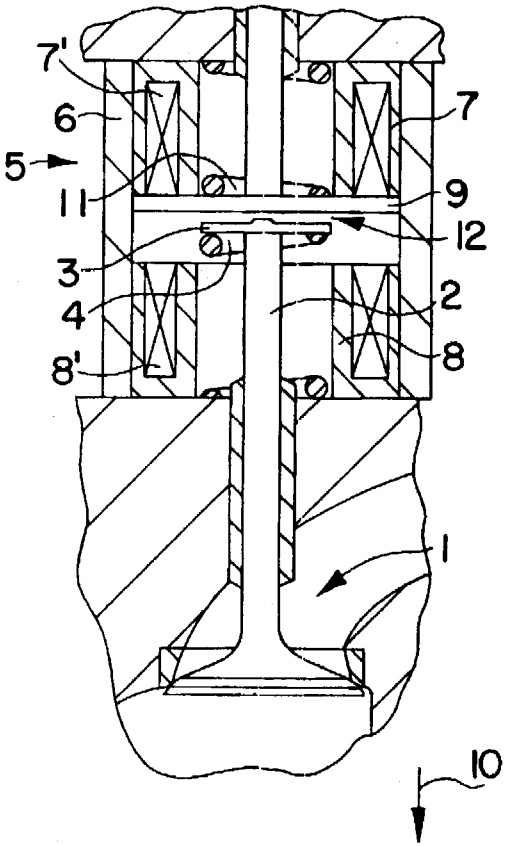

FIG. 1 illustrates a cylinder valve 1 whose valve stem 2 carries at its end an abutment disk 3 which countersupports a closing spring 4 which, in turn, holds the valve 1 in the shown closed position.

The cylinder valve 1 is operated by an electromagnetic actuator generally designated at 5 having a housing 6 and two spaced and aligned electromagnets 7 and 8 disposed in the housing. The electromagnet 7 which has a solenoid 7', is a valve closing magnet whereas the electromagnet 8 which has a solenoid 8', is a valve opening magnet. Between the two electromagnets 7 and 8 an armature 9 is disposed which is supported for reciprocating motion and which is urged in the opening direction 10 by a return spring 11. If the closing magnet 7 is energized, the armature 9 engages the pole face of the closing magnet 7 as shown in the Figure. Since the armature 9 and the valve 1 are not fixedly connected to one another, it is feasible to set a gap 12, constituting a valve play, by relocating the closing magnet 7 approximately 0.6 mm within the housing 6 parallel to the motion path of the valve 1 between the armature 9 and the abutment disk 3. The size of the valve play is so designed that, for example, different heat expansions at different operational conditions do not, at any time, lead to a condition in which, when the armature 9 is held in the "valve closed" position, a contacting or even a pressing of the abutment disk 3 by the armature 9 occurs.

Upon deenergization of the closing magnet 7, the armature 9 is moved by the return spring 11 towards the abutment disk 12 of the valve 1, at which time the return spring 11 moves and accelerates only the mass of the armature 9. As the armature 9 impacts on the abutment disk 3, not only the mass of the valve needs to be accelerated but simultaneously the opposing force of the closing spring 4 has to be overcome as well. By virtue of the still-present magnetic field generated by the closing magnet 7, the movement of the armature 9 away from the pole face of the closing magnet 7 causes a change in the magnetic flux. As a result, across the solenoid 7' of the closing magnet 7 a voltage appears which is proportionate to the change of the magnetic flux. A sudden change in the motion of the armature 9 caused by impacting the abutment disk 3 involves a sudden voltage change across the solenoid 7' which can be evaluated. If the time is measured which lapses after the deenergization of the holding current or from the moment of separation of the armature from the pole face until the appearance of a corresponding event (spike) in the voltage course, conclusions may be drawn concerning the magnitude of the valve play constituted by the gap 12.

If by relaxing the return spring 11 working in the opening direction or by other mechanical means the valve 1 is held in its closed position, the above-described measuring steps may be effected when the armature 9, in the deenergized state of the closing magnet 7, initially contacts the abutment disk 3 as urged by the return spring 11. If the closing magnet 7 is energized then, as described above, in the course of the voltage and/or current significant changes occur at the moment in which the armature 9 impacts the pole face of the closing magnet 7. From these events, possibly in combination with a time measurement, the size of the gap 12 (that is, the size of the valve play) may be determined.

In the above-described mode of operation, while the valve 1 is mechanically immobilized in the closed position, either by direct mechanical fixing or by relaxing the return spring 11, the magnitude of the valve play determined by the gap 12 may be ascertained still in different ways. Since the magnetic force decreases quadratically as the distance of the armature from the pole face increases, the armature, corresponding to the magnitude of the available gap 12, can be moved in the direction of the closing magnet 7 from its position where it engages the abutment disk 3 only when a magnetic force derived from a current of appropriate intensity moves the armature 9 towards the closing magnet 7 against the force of the return spring 11, whether the latter is set to its normal operational tension or whether it is partially relaxed.

The voltage curves shown in the diagrams of FIGS. 2*a*, 2*b* 2*c* and 2*d* illustrate how the different widths of gap 12 change the magnetic flux. This change of magnetic flux causes a change in the course of voltage dependent from time and is visible as a peak.

Diagram 2*a* shows the course of voltage when gap 12 has a width of 0 mm. There is no peak in the voltage course.

Diagram 2*b* shows the course of voltage when gap 12 has a width of 0.2 mm. In this case a small peak 13 can be seen indicating the sudden change in the motion of the armature 9 caused by impacting the abutment disk 3 after a time $t_1$.

Diagram 2*c* shows the course of voltage when gap 12 has a width of 1.2 mm. Peak 14 occurs at time $t_2$, which is later than $t_1$ according to the greater width of gap 12.

Diagram 2*d* shows the course of voltage when gap 12 has a width of 2.2 mm. Peak 15 occurs at time $t_3$, which is even later because of the greater distance which is to be travelled by the armature 9 in comparison to diagram 2*b* or 2*c* respectively.

As can be see from these diagrams, according to an embodiment of the method, a measuring of the width of the gap 12 can be carried out by measuring the time, beginning from a deenergization of the solenoid 7' up to the peak occurring in the course of voltage, when the armature 9 impacts on the abutment disk 3, so that no access to the actuator is necessary. The course of voltage can be made visible on a screen or any other suitable instrument of recording.

It will be understood that the above description of the present invention is susceptible to various modifications, changes and adaptations, and the same are intended to be comprehended within the meaning and range of equivalents of the appended claims.

What is claimed is:

1. A method of measuring a valve play in a reciprocating valve having open and closed positions and being operated by an electromagnetic actuator including an opening electromagnet, a closing electromagnet, an armature movable between pole faces by electromagnetic forces against a spring force of return spring means for moving said valve into an open position; said valve play being defined by a clearance between said armature and said valve when said armature is in contact with the pole face of said closing magnet and said valve is in said closed position; the method comprising the following steps:

(a) detecting a motion of the armature within said clearance as a function of at least one of a course of voltage and a course of current in said closing electromagnet; and (b) deriving the size of said valve play from an irregularity in at least one of said course of voltage and said course of current; said irregularity being caused by an impacting of said armature on at least one of said valve and said pole face of said closing electromagnet.

2. The method as defined in claim 1, wherein said armature has two end positions at opposite ends of the valve play and said closing electromagnet has a solenoid; further comprising the steps of (a) holding the armature in one of said end positions;

(b) during the holding step, energizing said closing electromagnet by passing a current therethrough; and (c) detecting at least one of a course of voltage and a course of current in said solenoid from the moment of energizing said closing electromagnet.

3. The method as defined in claim 2, further comprising the steps of (a) measuring the time lapse between the moment of energizing said closing electromagnet and said irregularity; and (b) deriving the size of said valve play from the measured time lapse.

4. The method as defined in claim 1, further comprising the steps of (a) passing a current through said closing electromagnet for causing said valve to be held in said closed position; and (b) initiating the detecting step by switching off the current through said closing electromagnet.

5. The method as defined in claim 4, further comprising the step of defining the moment of switching off the current through said closing electromagnet by recognizing a separation of said armature from said pole face of said closing electromagnet.

6. The method as defined in claim 5, further comprising the steps of (a) re-energizing said closing electromagnet subsequent to switching off the current therethrough; and (b) deriving the size of said valve play from at least one of the course of voltage and the course of current.

7. The method as defined in claim 5, further comprising the steps of (a) re-energizing said closing electromagnet subsequent to switching off the current therethrough; and (b) deriving the size of said valve play by measuring the time lapse to the moment of return of the armature into abutment with the pole face of said closing electromagnet.

8. The method as defined in claim 1, further comprising the step of mechanically immobilizing said valve in the closed position.

9. The method as defined in claim 8, wherein the step of mechanically immobilizing said valve comprises the step of at least partially relaxing a return spring exerting a spring force in an opening direction of said valve.

10. The method as defined in claim 8, further comprising the steps of (a) energizing said closing electromagnet from a deenergized state, while mechanically immobilizing said valve in the closed position, by passing a current of increasing intensity through said closing electromagnet; and (b) deriving the size of said valve play from the intensity of the current passing through said closing electromagnet and required for moving the armature into abutment with said pole face of said closing electromagnet.

* * * * *